US005865587A

United States Patent [19]

Politt

[11] Patent Number: 5,865,587

[45] Date of Patent: Feb. 2, 1999

[54] TOOL FOR A SEAMING MACHINE

[75] Inventor: Hans-Dietrich Politt, Baddeckenstedt, Germany

[73] Assignee: Maiko Engineering GmbH, Germany

[21] Appl. No.: 676,307

[22] PCT Filed: Jan. 18, 1995

[86] PCT No.: PCT/DE95/00059

§ 371 Date: Jul. 18, 1996

§ 102(e) Date: Jul. 18, 1996

[87] PCT Pub. No.: WO95/19858

PCT Pub. Date: Jul. 27, 1995

[30] Foreign Application Priority Data

Jan. 19, 1994 [DE] Germany ..... 44 01 446.5
Apr. 5, 1994 [EP] European Pat. Off. ..... 94105287

[51] Int. Cl.[6] ..... B21D 51/32

[52] U.S. Cl. ..... 413/31; 413/6

[58] Field of Search ..... 413/31–41, 6; 53/340

[56] References Cited

U.S. PATENT DOCUMENTS

| | | | |
|---|---|---|---|
| 3,441,170 | 4/1969 | Khoury | 220/54 |
| 4,055,133 | 10/1977 | Wessely | 413/6 |
| 4,271,778 | 6/1981 | Le Bret | 413/6 |
| 4,354,784 | 10/1982 | Westphal | 413/12 |
| 4,392,295 | 7/1983 | Sasai et al. | 29/509 |
| 4,513,487 | 4/1985 | Binnie | 413/32 |
| 4,540,323 | 9/1985 | Inoue | 413/36 |
| 4,578,007 | 3/1986 | Diekhoff | 413/6 |
| 4,626,158 | 12/1986 | Le Bret | 413/6 |
| 5,049,019 | 9/1991 | Franek | 413/6 |
| 5,143,504 | 9/1992 | Braakman | 413/6 |

FOREIGN PATENT DOCUMENTS

| | | |
|---|---|---|
| 0088968 | 7/1986 | European Pat. Off. . |
| 2303943 | 5/1974 | Germany . |
| 2121332 | 12/1983 | United Kingdom . |
| 2202777 | 10/1988 | United Kingdom . |
| 2225265 | 5/1990 | United Kingdom . |

OTHER PUBLICATIONS

Handbuch der Dosenfertigung, Von Waldemar Friebel VDI, Lübeck —1936, pp. 74–85.

*Primary Examiner*—John Sipos
*Assistant Examiner*—Christopher W. Day
*Attorney, Agent, or Firm*—Eckert Seamans Cherin & Mellott, LLC

[57] ABSTRACT

Tooling for use with a folded cover seaming machine having a seaming chuck with a profile and a corresponding movable seaming roller formed with a mating profile operable to couple a can end to the walls of a can. The cross sectional thickness of the seaming roller in the transition area is reduced and the corresponding cross sectional thickness of the seaming chuck is increased. The increased thickness of the seaming chuck provides additional strength thereby reducing the occurrence of structural defects or fissures in the seaming chuck. The deceased thickness of the seaming roller provides a contour which minimizes the possibility of damage to cans and jamming of the seaming machine due to jamming in cases where no can end is supplied.

14 Claims, 3 Drawing Sheets

TOOL FOR A SEAMING MACHINE

BACKGROUND OF THE INVENTION

1. Field of the Invention

The invention relates to a tool for seaming machines.

2. Prior Art

Such a tool comprises of a central seaming chuck which engages the can end by contacting its chuck wall and pushing said can end into the can opening with its seaming chuck lip when lifting the supporting means carrying the upright standing can, and presses the flared flange of the can end against the flared flange of the can in a direction opposite to the resilience effective at said supporting means, maintaining said can end in a predetermined position with respect to the seaming rollers, thus allowing to radially adjust said rollers without impediment until their groove is able to engage said flared flanges lying one upon the other and to deform them in the desired manner. Can seaming machines for cans rotating during the seaming procedure are usually not provided with a stripping means above said seaming chuck lip. In these cases, said seaming rollers have stripping function. For this purpose, the diameter of said rollers above said profiled groove must be markedly larger than the diameter below said profiled groove and must overlap said seaming chuck lip in radial direction when the rollers are adjusted. For this purpose, a corresponding undercut is provided on the upper side of said seaming chuck in which undercut said roller section of larger diameter is received ("drives in") when adjusting the rollers.

The shape of said seaming chuck lip is substantially defined by said undercut and by a center recess on the lower surface of said seaming chuck, which recess is determined for receiving a tear-off means of tear-off can ends. Thus, the cross section of the transition area between lip and center section of said seaming chuck becomes relatively small with the risk of fissures or even breaks at said transition area due to strong alternating stresses. The risk increases with increasing chuck wall height of said can end and increasing height of said seaming chuck lip.

The center section of said seaming chuck could be enlarged to strengthen said transition area, but then, the stripping function of the seaming rollers is lost.

If during a seaming procedure no can end was supplied to the can to be closed next, the seaming chuck is not able to press the can down against the resilience of said supporting means, when lifting said supporting means. Thus, the flared flange of the can is positioned considerably higher with respect to said seaming chuck lip and said seaming rollers. When (laterally) adjusting said seaming rollers, there is a risk that the flared flange of the can is rolled over the shoulder of the seaming chuck which shoulder being formed by the undercut; consequently, the can cannot be stripped and the machine has to be stopped.

SUMMARY OF THE INVENTION

The object of the invention is to avoid said disadvantages and to improve a tool for a seaming machine in such a way that, even in case of a large chuck wall height, there is no risk of fissures or breaks of the seaming chuck lip, no risk of forming or deforming said flared flange of the can over said seaming chuck if the can end is missing, and that the seaming rollers are able to reliably effect a stripping function.

According to the invention, the transition area between said seaming chuck lip and a center area of said seaming chuck is sufficiently strengthened to allow reliable resistance to strong alternating stresses even in case of great length of said lip. A desired stripping function of said seaming rollers is not affected thereby, because the necessary large diameter in the upper section of said rollers may be maintained by a corresponding selective reduction of the cross section of said rollers and, nevertheless, the roller is able to sufficiently engange the undercut of the seaming chuck when being adjusted.

If the can end is missing and the flared flange of the can is located correspondingly high, contouring provides a reliable engagement of said seaming rollers in their adjustment movement at the flared flange, without deforming said flange over said seaming chuck. Thus, the rollers are able to reliably strip the unseamed can in the further seaming procedure, so that no appreciable operating breakdown may occur.

The invention is described in detail by schematic drawings on the basis of several embodiments.

DETAILED DESCRIPTION OF PREFERRED EMBODIMENTS

Figure 1:
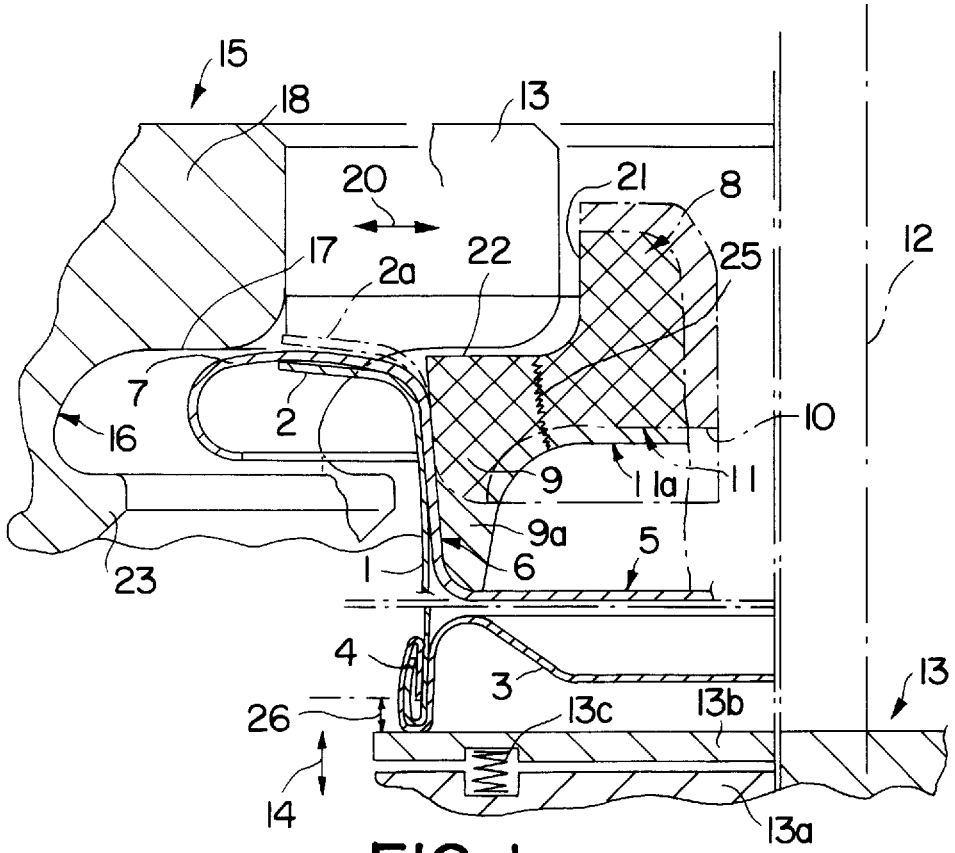
FIG. 1 is a cross-sectional view of a section of a tool for a seaminng machine in accordance with the prior art.

Seaming machines for seamed can ends are generally known, so that a detailed illustration and description thereof is not necessary.

The present embodiment is based on a seaming machine not being provided with a stripping means above a seaming chuck lip to be described in the following. The appropriate tool for such a machine is provided with an elevating means 13, which may be lifted and lowered in direction of a tool axis and the supporting means 13*a* of which, receiving the cans standing upright, is resiliently supported by springs 13*c* or the like. The movement of said elevating means in direction of said tool axis 12 is indicated by a double arrow 14.

A seaming chuck 8, which may be stationary in axial direction, is positioned in the same axial direction as said elevating means. Said seaming chuck is provided with a recess 11 on its lower side, which recess being positioned and dimensioned such that a suitably shaped tear-off mechanism of a tear-off can end 5 may be received in it without contacting it.

Said seaming chuck has an undercut defined by first and second flanks 21,22 on its upper side. Said undercut and recess 11 delimit a seaming chuck lip 9 extending in radially outward direction and protruding downwards, the outer surface of which contacts the chuck wall 6 of said can, if said can 1 with said loosely positioned can end 5 is lifted by said elevating means 13 on which the bottom 3 of the can stands with its (lower) seamed edge for initiating the closing procedure.

FIG. 1 shows two typical shapes of seaming chucks having lips 9 and 9*a* of different lengths and different recesses 11 and 11*a* respectively. Said different lips are attributed to can ends with differently dimensioned chuck wall lengths or heights. If a can end 5 is positioned on the can, the flared flange 7 of said can end covers the flared flange 2 of said can. Seaming rollers 15 serve for forming the seam, one of which rollers is shown in FIG. 1 in a sectional view.

During the seaming process, the rotatable rollers are moved (adjusted) in radial direction with respect to axis 12 from a non-adjusted position as shown in hatched representation to a position illustrated by a simple contour line. Said adjustment movement is effected in a similar way as the lifting movement of said elevating means, e.g. by corresponding peripheral cams.

Said rollers 15 are provided each with a profiled groove 16 being open in radially inward direction and effecting the actual deformation. The upper delimitation flank 16 *a* of said profiled groove 16 passes over a shoulder 17 extending in axial direction into a cylindrical surface of an upper roller section 18, the diameter of which is substantially larger than the diameter of a roller section 23 below said profiled groove 16. The diameter difference may for example be 6 mm. Said difference ensures that said upper roller section 18 engages said undercut 21,22 in the radially inner position 19 of said roller and overlaps said seaming chuck lip 9,9*a* in radial direction.

Said dimensioning is necessary to enable the seaming rollers 15 to engage the flared flange 2 of the can if the can end is missing and if the rollers are not adjusted, and to strip said can from said seaming chuck. Said adjustment movement of said rollers 15 is indicated by a double arrow 20.

FIG. 1 shows that the transitional cross section between said lip 9,9*a* and said center recess 10 of said seaming chuck is relatively narrow. Practice shows that fissures 25 may occur in said transitional area or that said lip completely breaks with the occurring strong alternating stresses.

FIG. 1 also shows that, if the can end is missing, springs 13*c* lift said can 1 with its flared flange 2 by a distance or range 26 to a position 2*a* with the consequence that, when adjusting said rollers 15, the flared flange of the can is pushed and deformed in inward direction over the shoulder 22 of said seaming chuck 8, so that said can may not be disengaged from said seaming chuck.

Figure 2:
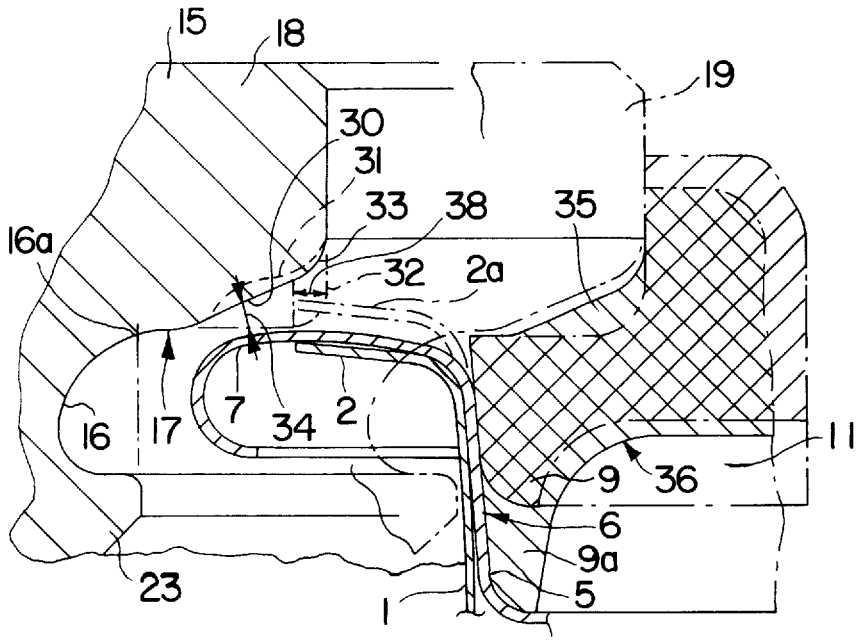
FIG. 2 is a similar view of a tool according to the invention.

In FIG. 2, said tool is modified in such a way that all the above mentioned dangers, risks and disadvantages are avoided. Similar components and sections, as far as they remain unchanged, are designated by the same reference numerals as in FIG. 1.

FIG. 2 illustrates that the transition area between said lip 9,9*a* and said center section of said seaming chuck is considerably strengthened by an increased diameter. Said diameter enlargement is located substantially in the direction of arrow 36 and is obtained by a diameter increase exclusively in a section 35 of said undercut by filling up an area situated in radially inward and axially downward direction of said undercut. The radial depth and the axial height of said undercut are thus generally maintained. The diameter portion added to said chuck is removed correspondingly at said rollers 15 without influencing either said profiled groove 16 or the diameter of said upper roller section 18. The engagement of said roller 15 into the undercut at position 19 as well as a radial overlapping 38 of the flared flange of said can in position 2*a* is possible without modification.

Reference numeral 32 indicates the original course of the contour of said roller, whereas reference numerals 30 and 31 indicate two out of many possible contour lines in the concerned area of said rollers 15.

It can be recognized that said seaming chuck lip 9,9*a* is considerably strengthened by the described measures. Practice shows that the risk of fissures or breaks is avoided even in case of high alternating stresses and very long lips 9,9*a*.

Even in cases, where a strengthening of said lip 9,9*a* seems not to be necessary, it was found to be of advantage to provide instead of said contour line 35 a contour line 30 or 31 or similar on said seaming rollers at the axially extending shoulder 17, such that said line extends from about the upper delimitation flank of said profiled groove and continues in radially inward and axially upward direction. The average angle 34 should be below 60° and preferrably about 45° or less. The contoured line may define a tapered surface or an irregularly profiled surface.

By said measure it is avoided that, if said can end 5 is missing, said rollers 15 take said flared flange 2 of the can along from a position 2*a* in their radial adjustment movement and deform it in radial direction over the shoulder 22 of said seaming chuck 8.

As illustrated by FIG. 2, the steps taken to modify the cross section and to modify the contour of said rollers may be coordinated to achieve the desired strengthening of said seaming chuck lip 9,9*a* as well as the desired engagement inclination 30,31 for said flared flange 2*a*.

Figure 3A:
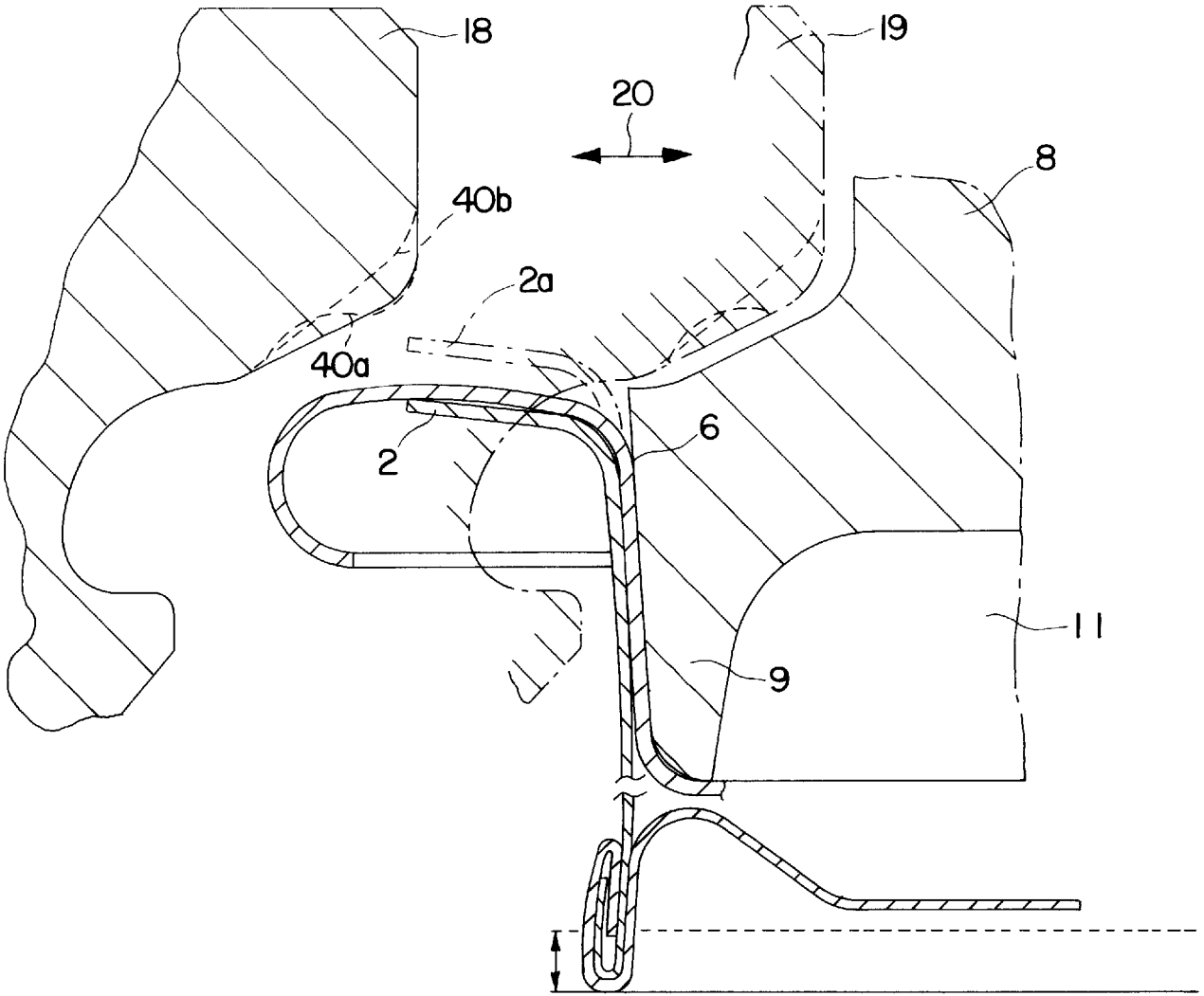
FIGS. 3A and 3B show further details of modified embodiments.
Figure 3B:
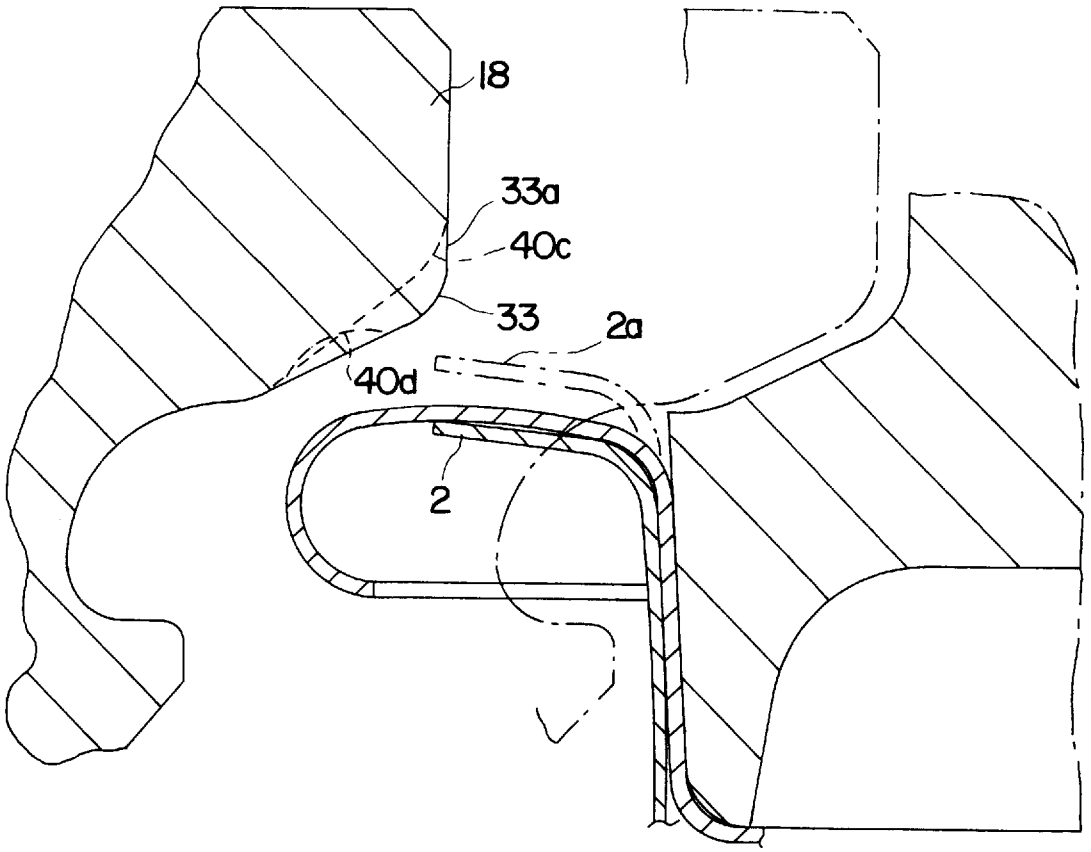

FIG. 3A and FIG. 3B show further possible embodiments of contoured lines according to 40*a* to 40*d*.

I claim:

1. Tool for can seaming machine for the seaming or closing of a can and a tear-off end, comprising:

a seanming chuck having a tool axis, a center recess and a center area;

a supporting means for an upright standing can, said supporting means being moveable in a direction upwards and downwards in direction of said tool axis and relative to said seaming chuck and being resiliently supported in said direction; and at least one seaming roller having a lower rolling section and an upper roller section of a first and second diameter respectively, being adjustable in a direction perpendicular to said tool axis and the roller being provided with a profiled groove in the lower roller section for rolling up or welting of flared flanges of the can end and the can;

said profiled groove being open in a radially inward direction and having an upper delimiting flank passing over a shoulder into said upper roller section, the second diameter being substantially larger than the first diameter;

said section of larger diameter being received in a corresponding annular undercut having first and second flanks on an upper side of said seaming chuck when adjusting said roller;

wherein said seaming chuck has said center recess provided on its lower side, for receiving a tear-off means of said can end, which recess, together with said undercut on said seaming chuck, delimits a circumferential seaming chuck lip on said seaming chuck for engaging the chuck wall of said can end;

wherein, when viewed in cross-section, said seaming chuck has a transition surface for strengthening the seaming chuck the transition surface being defined by a first contour line extending between said first and second flanks, said first contour line conforming to an extension between the first and second flanks at a first acute angle with respect to a plane extending radially from the tool axis;

said seaming roller having a corresponding transition surface for providing reliable stripping of the can, tile transition surface being defined by a second contour line extending between said shoulder and said upper roller section said second contour line conforming to an extension between the shoulder and the upper roller section at a second acute angle with respect to the Diane extending radially from the tool axis; and whereby the transition surfaces of the seaming roller and chuck are overlapable without interference.

2. Tool according to claim 1, wherein averaged throughout its extension, at least one of said first and second acute angles are less than 60°.

3. Tool according to claim 2, wherein the supporting means has a resiliently supported elevating means, providing a resiliently supported range of motion along the tool axis and in cross-sectional view, said contoured line has an extension in the direction of said tool axis being at least equal to said range.

4. Tool according to claim 1, wherein for use with seaming machines, the cans are rotatably driven during seaming action or inserted axially along the tool axis and standing upright without rotary movement.

5. Tool according to claim 1, wherein said first acute angle and said second acute angle are substantially equal.

6. Tool according to clam 1, wherein at least one of the first and second contour lines define one of a tapered surface and an irregularly profiled surface.

7. A method for seaming a can and can end comprising:

providing a can end having a flared flange;

providing a can having a flared flange seamable with said flared flange of said can end;

providing a tool for seaming a can with a can end, said tool having a seaming chuck, said seaming chuck having a chuck lip, an undercut having first and second flanks, a recess, a transition surface for strengthening the seaming chuck, and a center area, said transition surface being defined by a first contour line extending between said first and second flanks, said first contour line confining to an extension between the first and second flanks at a first acute angle with respect to a plane extending radially from the tool axis;

said tool further including at least one seaming roller including a profiled groove having an upper delimitation flank, a corresponding transition surface for providing reliable stripping of the can, and an upper roller section, said transition surface being defined by a second contour line extending from said upper delimitation flank to said upper roller section, said second contour line conforming to an extension between the upper delimitation flank and upper roller section at a second acute angle with respect to the plane extending radially from the tool axis wherein said transition surface is matingly engageable with said transition surface of said seaming chunk;

placing said can on the tool, the central axis of said can being in alignment with said tool axis;

placing said can end on the can, said can end flange and said can flange being in mated alignment;

engaging said seaming chuck with said can end to retain said can cad in a fixed position with respect to said can;

engaging said seaming roller with said aligned flared flanges of said can and said can end, such that said seaming roller imparts deformation forces on said flared flanges, sufficient to seam said can and said can; and whereby the transition surfaces of the seaming roller and chuck overlap without interference.

8. Tool according to claim 7, further comprising a supporting means having a resiliently supported elevating means, providing a resiliently supported range of motion along the tool axis and in cross-sectional view, said contoured line having an extension in the direction of said tool axis being at least equal to said range.

9. Tool according to claim 7, wherein said first acute angle and said second acute angle are substantially equal.

10. Tool according to claim 7, wherein at least one of the first and second contour lines define one of a tapered surface and an irregularly profiled surface.

11. A method for avoiding the breakdown of seaming machine when a can is supplied to the seaming machine without a corresponding can end comprising:

providing a can having a flared flange;

providing a tool for seaming a can with a can end, said tool having a seaming chuck, said seaming chuck having a chuck lip, a chuck shoulder, an undercut having first and second flanks, a recess, a transition surface for strengthening the seaming chuck, and a center area, said transition surface being defined by a first contour line extending between said first and second flanks, said first contour line conforming to an extension between the first and second flanks at a first acute angle with respect to a plane extending radially from the tool axis;

said tool further including at least one seaming roller including a profiled groove having an upper delimitation flank, a corresponding transition surface for providing reliable stripping of the can, and an upper roller section, said transition surface being defined by a second contour line extending from said upper delimitation flank to said upper roller section, said second contour line conforming to an extension between the upper delimitation flank and upper roller section at a second acute angle with respect to the plane extending radially from the tool axis wherein said transition surface being is matingly engageable with said transition surface of said seaming chucks;

said tool further including a resilient supporting means. said resilient supporting means being depressible when said seaming chuck engages said can end such that said flared flange of said can is in alignment with said profiled groove of said sea roller;

placing said can on said resilient supporting means of said tool, the central axis of said call being in alignment with said tool axis;

engaging said seaming chuck with said can such that said resilient supporting means is not depressed and said flared flange of said can is not aligned with said profiled groove of said seaming roller;

engaging said seaming roller with said flared flange of said can, such that said seaming roller imparts deformation forces on said flared flange which avoid forming the flared flange of the can inward and over the seaming chuck shoulder; and stripping said can from said tool using said seaming roller; and whereby the transition surfaces of the steaming roller and chuck overlap without interference.

12. Tool according to claim 11, wherein the supposing means has a resiliently supported elevating means, providing a resiliently supported range of motion along the tool axis and in cross-sectional view, said contoured line has an extension in the direction of said tool axis being at least equal to said range.

13. Tool according to claim 11, wherein said first acute angle and said second acute angle are substantially equal.

14. Tool according to claim 11, wherein at least one of the first and second contour lines define one of a tapered surface and an irregularly profiled surface.

* * * * *

UNITED STATES PATENT AND TRADEMARK OFFICE

CERTIFICATE OF CORRECTION

PATENT NO. : 5,865,587
DATED : February 2, 1999
INVENTOR(S) : Hans-Dietrich Politt It is certified that error appears in the above-identified patent and that said Letters Patent is hereby corrected as shown below:

Title page,
Item [57], ABSTRACT,
Line 10, delete "deceased" and insert therefor -- decreased --.

Drawings,
Sheet 1, Figure 1, delete Figure 1 in its entirety and insert therefor the following:

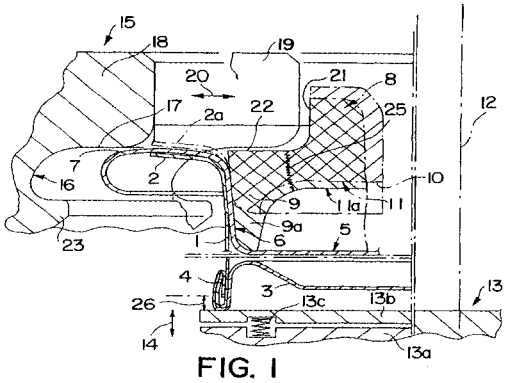

FIG. 1

Column 4,
Line 36, delete "rolling" and insert therefore -- roller --;
Line 66, delete "tile" and insert therefor -- said --;

Column 5,
Line 5, delet "Diane" and insert therefor -- plane --;
Line 56, delete "cad" and insert therefor -- end --;
Line 64, delete "Tool" and insert therefore -- Method --;

Column 6,
Lines 3, 5, 55, 61 and 63, delete "Tool" and insert therefore -- Method --;
Line 39, delete "sea" and insert therefore -- seaming --;
Line 41, delete "call" and insert therefore -- can --;

UNITED STATES PATENT AND TRADEMARK OFFICE

CERTIFICATE OF CORRECTION

PATENT NO. : 5,865,587
DATED : February 2, 1999
INVENTOR(S) : Hans-Dietrich Politt It is certified that error appears in the above-identified patent and that said Letters Patent is hereby corrected as shown below:

Column 6 (cont'd),
Line 55, delete "supposing" and insert therefore -- supporting --.

Signed and Sealed this

Seventeenth Day of August, 2004

JON W. DUDAS
*Acting Director of the United States Patent and Trademark Office*